US007690731B2

(12) United States Patent
Kuester

(10) Patent No.: US 7,690,731 B2
(45) Date of Patent: Apr. 6, 2010

(54) HIGHCHAIRS

(75) Inventor: Stephen Michael Kuester, Kidlington (GB)

(73) Assignee: Medel Group S.p.A., San Polo di Torrile (Parma) (IT)

( * ) Notice: Subject to any disclaimer, the term of this patent is extended or adjusted under 35 U.S.C. 154(b) by 164 days.

(21) Appl. No.: 10/554,592

(22) PCT Filed: Mar. 26, 2004

(86) PCT No.: PCT/GB2004/001393

§ 371 (c)(1),
(2), (4) Date: Oct. 27, 2005

(87) PCT Pub. No.: WO2004/084680

PCT Pub. Date: Oct. 7, 2004

(65) Prior Publication Data

US 2006/0290191 A1 Dec. 28, 2006

(30) Foreign Application Priority Data

Mar. 28, 2003 (GB) ..... 0307202.2

(51) Int. Cl.
*A47C 1/12* (2006.01)
*A47B 83/02* (2006.01)

(52) U.S. Cl. ..... 297/447.1; 297/153

(58) Field of Classification Search ..... 297/447.1, 297/447.3, 446.1, 451.2, 451.11, 451.12, 297/153, 148, 448.2, 149, 150, 151, 55, 58, 297/440.12, 377, 328; D6/339
See application file for complete search history.

(56) References Cited

U.S. PATENT DOCUMENTS 2,647,560 A * 8/1953 Huebener ..... 297/328
2,670,787 A * 3/1954 Vandas et al. ..... 297/411.41

(Continued)

FOREIGN PATENT DOCUMENTS

DE 9311003.0 11/1993

(Continued)

OTHER PUBLICATIONS http://www.johnlewis.com/stores/multiproduct.asp?shelfid=14731&str=906&Configurator=0&trsid=341&m=-1 (To Follow).

(Continued)

*Primary Examiner*—Milton Nelson, Jr.
(74) *Attorney, Agent, or Firm*—Pearne & Gordon LLP

(57) ABSTRACT

A collapsible highchair for an infant has a seat (3), a back-rest (4) and a front leg-support (5) that are provided in one by an elongate, contoured moulding (1). Rear leg-support is by tubular legs (2) which are pivoted to the one-piece moulding (1) under the seat (3) and which are held in rearward extension in the erect condition of the highchair by a pivoted tubular frame (10) which snaps into a socket (11) under the seat (3). Release of the frame (10) from the socket (11) allows the legs (2) to fold onto the underside of the front leg-support (5) for collapse of the chair. A tube (14) attached at each end under the seat (3) extends up either side of the seat (3) to form arm-rests (15), and a backwardly/forwardly slidable tray (18) is attached by releasable mounts (20) to the arm-rests (15).

10 Claims, 4 Drawing Sheets

U.S. PATENT DOCUMENTS

| | | | | | |
|---|---|---|---|---|---|
| 2,902,084 | A | * | 9/1959 | Stevens | 297/29 |
| 3,632,162 | A | * | 1/1972 | Trethaway | 297/149 |
| 4,210,182 | A | * | 7/1980 | Danko | 144/349 |
| D257,450 | S | * | 10/1980 | Radek | D6/373 |
| 4,946,180 | A | * | 8/1990 | Baer | 280/39 |
| 5,028,065 | A | * | 7/1991 | Danecker | 280/250.1 |
| 5,044,691 | A | * | 9/1991 | Guichon | 297/239 |
| 5,364,137 | A | * | 11/1994 | Shimer | 297/327 |
| 5,468,043 | A | | 11/1995 | Chien | |
| 5,810,432 | A | * | 9/1998 | Haut et al. | 297/153 |
| 5,927,805 | A | | 7/1999 | Hilger et al. | |
| 6,007,400 | A | * | 12/1999 | Lan | 446/71 |
| 6,089,666 | A | | 7/2000 | Rosko | |
| 6,305,750 | B1 | * | 10/2001 | Buono et al. | 297/440.2 |
| 6,398,304 | B1 | * | 6/2002 | Chen et al. | 297/327 |
| 6,481,790 | B2 | * | 11/2002 | Cheng | 297/153 |
| 6,666,510 | B2 | * | 12/2003 | Solomon | 297/219.12 |

FOREIGN PATENT DOCUMENTS

| | | |
|---|---|---|
| EP | 0049680 | 4/1982 |
| GB | 599243 | 3/1948 |

OTHER PUBLICATIONS http://www.christmas-guide.co.uk/Kuster_Highchair_Cushion_And_Booster_Pack,_Blue-81862.htm (To Follow).

http://www.johnlewis.com/stores/multiproduct.asp?shelfid=14731&str=906&Configurator=0&trsid=341&m=-1, a total of three (3) pages (published no earlier than Mar. 28. 2003).

http://www.christmas-guide.co.uk/Kuster_Highchair_Cushion_And_Booster_Pack,_Blue-81862.htm. a total of two (2) pages (published no earlier than Mar. 28, 2003).

* cited by examiner

HIGHCHAIRS

This application is a national stage completion of PCT/GB2004/001393 filed Mar. 26, 2004 which claims priority from British Application Serial No. 0307202.2 filed Mar. 28, 2003.

FIELD OF THE INVENTION

This invention relates to highchairs.

SUMMARY OF THE INVENTION

According to the present invention there is provided a highchair in which a seat having a back-rest is carried by respective front and rear leg-supports, wherein the seat, its back and the front leg-support are provided together in one by an elongate, unitary member.

The elongate member may be a one-piece moulding, and in these circumstances may be a laminate, and may have a core of wood (for example, ply-wood), plastics or a material of honeycomb structure. The laminate may be faced with a wood veneer or plastics (for example, a plastics having a melamine content such as that sold under the Registered Trade Mark FORMICA).

The rear leg-support, which may comprise a pair of legs, may be pivoted to the elongate member so that the highchair can be collapsed with the rear leg-support folded onto the front leg-support. A stay-element which is pivoted to the rear leg-support may be selectively engageable within a socket on the underside of the seat-portion of the elongate member for holding the rear leg-support extended rearwardly of the seat-portion in the erect condition of the highchair. Where the rear leg-support comprises a pair of legs, the stay-element may be a tubular frame located between the legs and pivoted to them.

BRIEF DESCRIPTION OF THE DRAWINGS

A collapsible highchair in accordance with the present invention will now be described, by way of example, with reference to the accompanying drawings, in which.

DETAILED DESCRIPTION OF THE INVENTION

Figure 1:
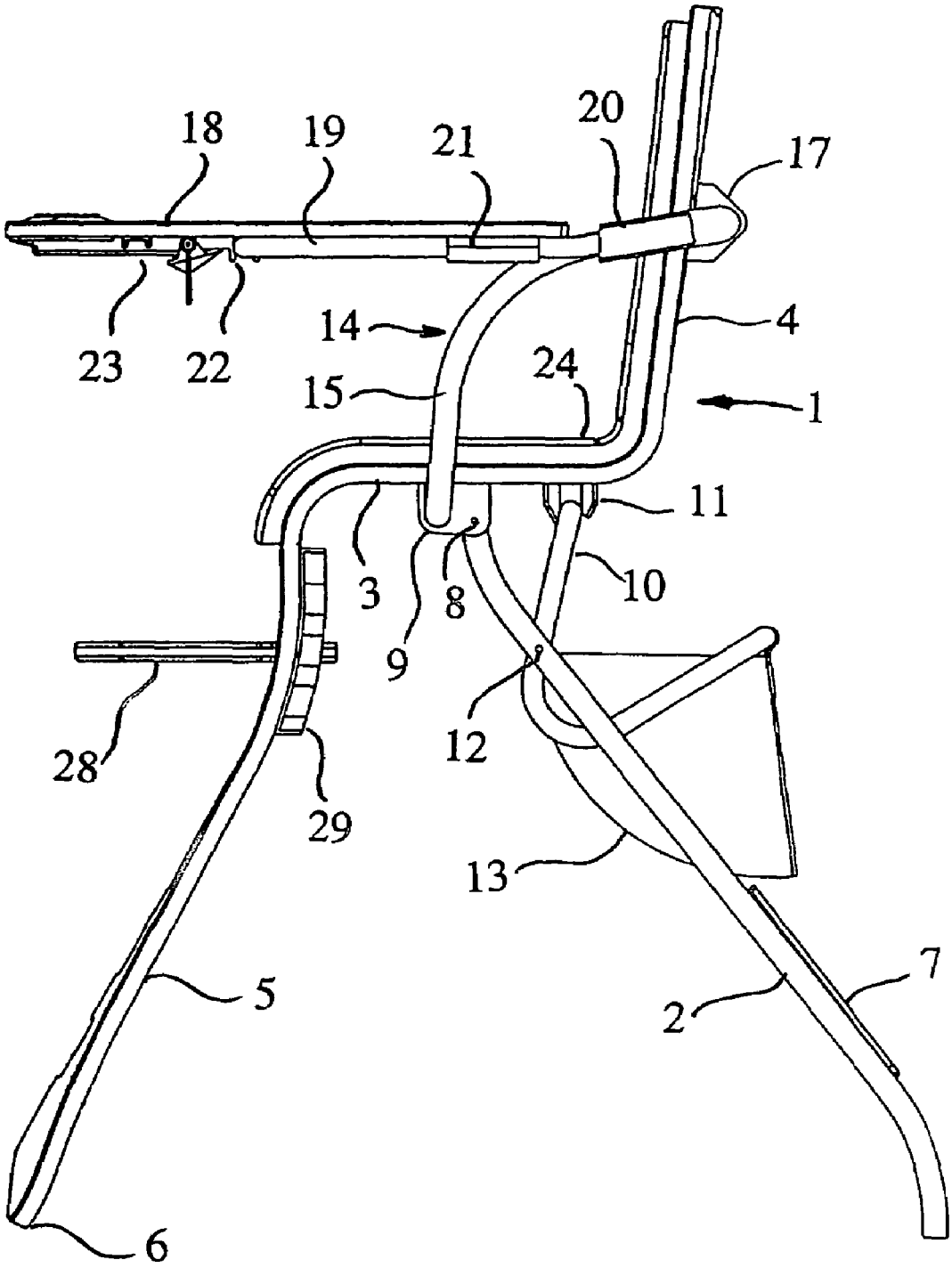
FIGS. 1 and 2 are, respectively, side and front elevations of the highchair according to the invention, in its erect condition.
Figure 2:
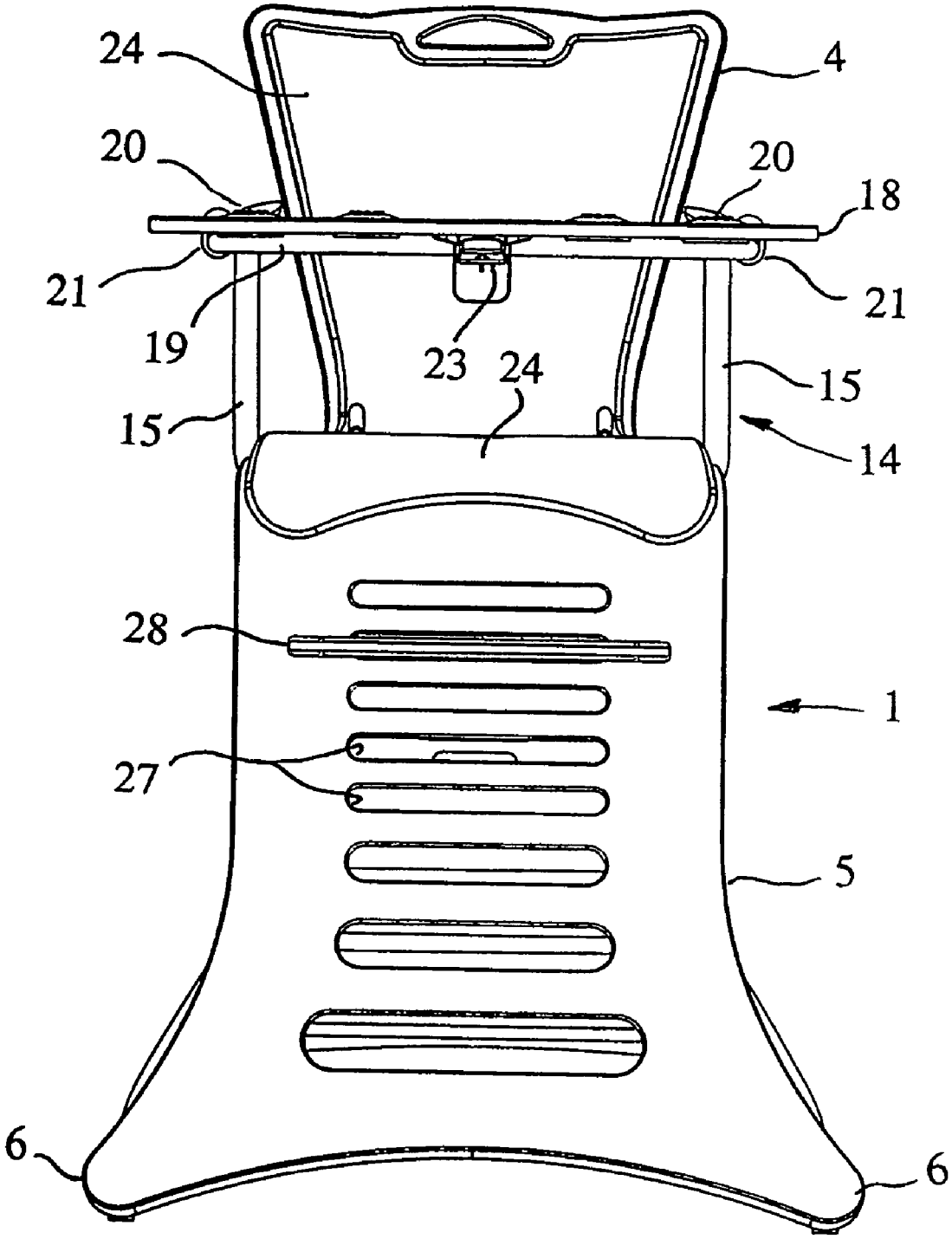
Figure 3:
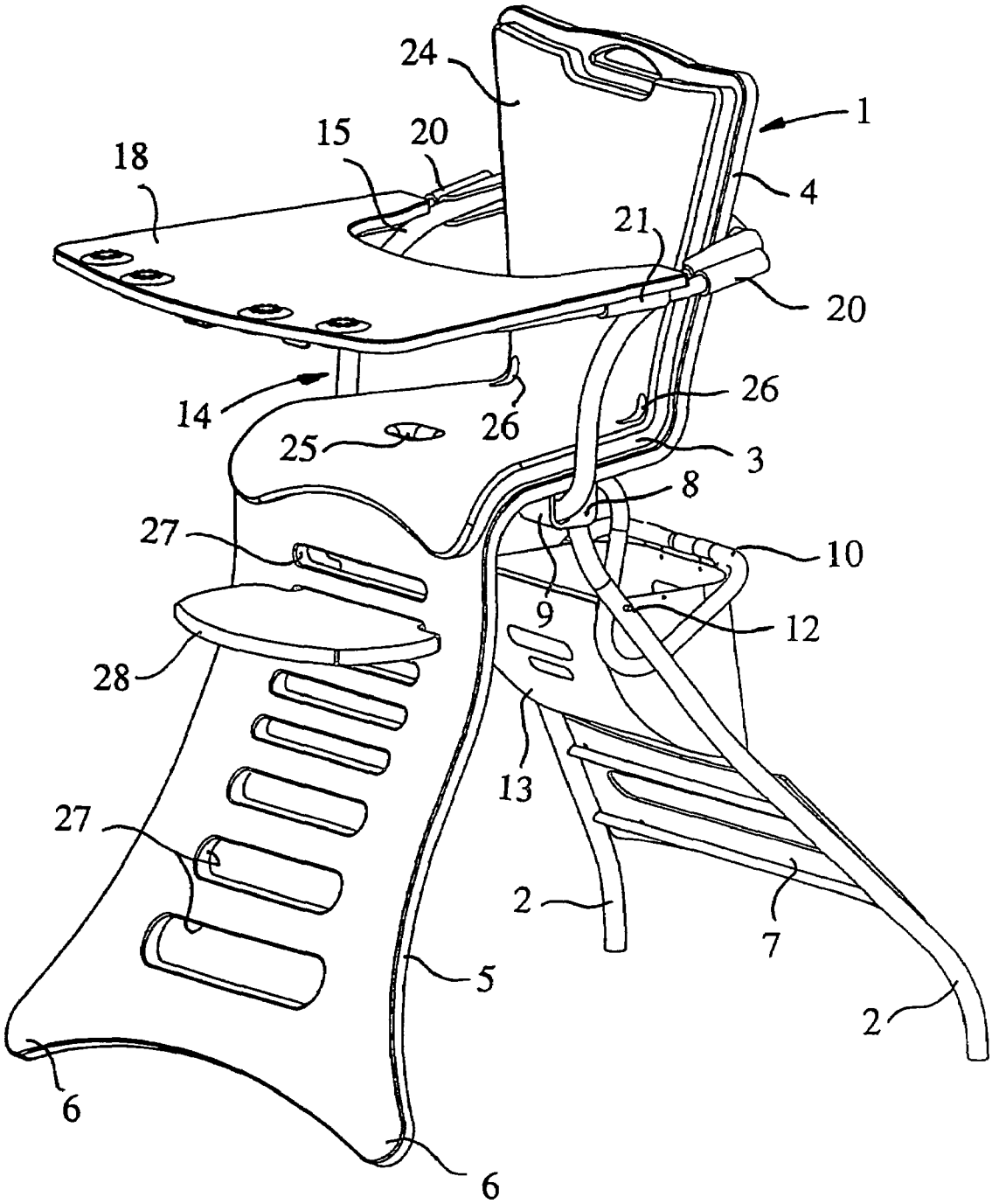
FIGS. 3 and 4 are perspective views of the erect highchair of FIGS. 1 and 2 from above and below respectively.
Figure 4:
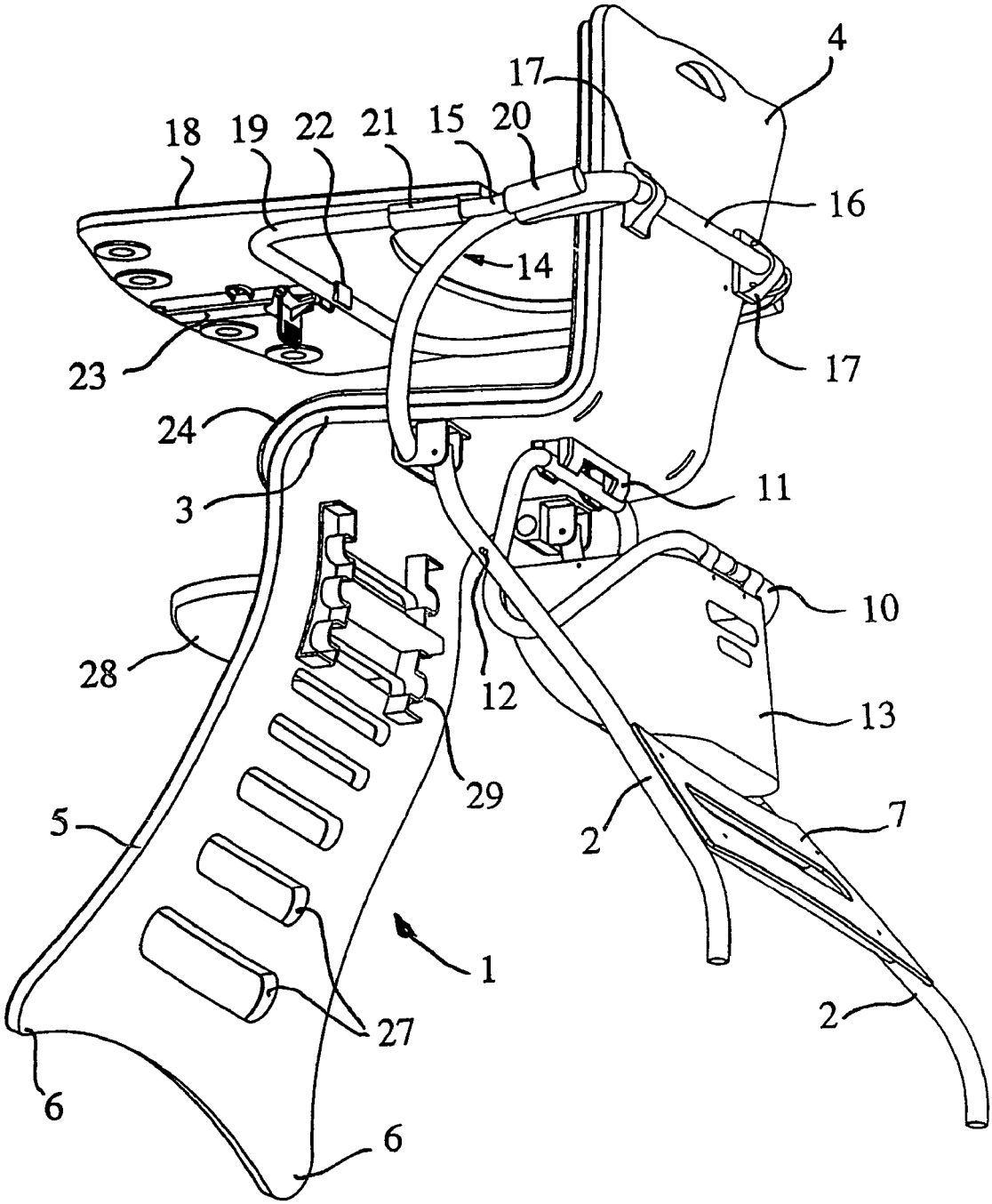

Referring to FIGS. 1 to 4, the highchair involves a unitary member in the form of a one-piece, elongate moulding 1 to which a pair of tubular-steel legs 2 are pivoted for rearwardly-inclined support of the highchair in its erect condition. The moulding 1 is contoured along its length to define for the erect condition, a substantially-horizontal portion 3 that forms the seat of the chair, a substantially-upright portion 4 curved up from the rear of the portion 2 to form a back-rest to the seat, and a longer portion 5 curved down from the front of the seat-portion 3 to provide a forwardly-inclined front leg-support for the chair. The width of the moulding 1 varies along its length also, narrowing down from the top of the back-rest portion 4 to run into the rear of the seat-portion 3, and then increasing slightly towards the front of the seat-portion 3. Substantially the same width is held from the front of the seat-portion 3 down to near the bottom of the leg-support portion 5, where the moulding 1 splays out to form foot projections 6 for floor-contact.

The tubular legs 2, which are interconnected by a cross-piece 7, are mounted on pivots 8 within respective brackets 9 secured to either side under the seat-portion 3. They are extended rearwardly for the erect condition of the highchair, by snap engagement of a stay-element in the form of tubular-steel frame 10, within a socket 11 mounted on the underside of the seat-portion 3. In this respect, the frame 10 is mounted on pivots 12 between the legs 2, and the action of engaging the frame 10 with the socket 11 pivots the legs 2 rearwardly. The weight of the highchair and its occupant acts to hold the legs 2 extended in this way so as to enhance retention of the frame 10 within the socket 11 and the highchair in its erect condition.

The highchair can be collapsed simply by withdrawing the frame 10 from engagement within the socket 11. This is achieved by lifting the legs 2 from the floor and pushing them forward to pivot about the brackets 9. In the fully-collapsed condition, the legs 2 are folded forwards onto the underside of the portion 5, and the highchair can be re-erected from this simply by pulling the legs 2 rearwardly and re-engaging the frame 10 with the socket 11. A basket or other container 13 is hung within the frame 10 and can be removed for the collapsed condition, or while the highchair is in the erect condition, simply by unhitching or otherwise detaching it from the frame 10.

The brackets 9 used for pivoting the legs 2 to the moulding 1, also serve for the attachment of a steel tube 14 that provide arm-rests to the seat. More particularly, the tube 14 has portions 15 at either end which curve upwardly from the brackets 9 to form the arm-rests either side of the seat-portion 3. The portions 15 at their upper ends, bend round the back of the back-rest portion 4 to be interconnected by a straight portion 16 of the tube 14 that is held to the portion 4 by brackets 17.

A forwardly-extending plastics tray 18 of the highchair is carried by a U-shape tubular-steel frame 19 which has a pivotal mount 20 at each end for engaging with the tube 14. More particularly, the mounts 20 engage releasably with the tube 14 at the tops of the arm-rest portions 15 respectively, where they bend into the portion 16. In fitting the frame 19 to the chair, it is positioned straddling the front of the back-rest portion 4 with the mounts 20 projecting just beyond it on either side. The frame 19 is then pulled forwards slightly to engage the mounts 20 with the tube 14 where the arm-rest portions 15 bend into the portion 16. Each mount 20 has the form of an elbow that is open on its inside (see the furthermost mount 20 represented in FIG. 3) so that it 'cups' onto the tube 14 around the bend. A manually-releasable catch (not shown) then becomes operative to hold it there. The frame 19, and with it the tray 18, is accordingly in this way firmly secured to the chair, but can be freed when desired, by releasing the catch and pushing the frame 19 slightly rearwards to disengage the mounts 20 from the tube 14.

The underside of the tray 18 has resilient-plastics sockets 21 to either side for snapping onto the two arms respectively of the tubular frame 19, and a manually-releasable clip 22 for clipping onto it centrally. Furthermore, a slide-mechanism 23 under the tray 18 is operable to allow adjustment of the tray-position, forwards or rearwards, relative to the frame 19; the sockets 21 are free to slide along the arms of the frame 19 as appropriate during the adjustment.

The frame 19, with or without the tray 18 attached, can be swung up from the horizontal into the substantially-vertical plane of the back-rest portion 4. In this respect, frame 19 is pivoted to each mount 20, but is held fast until a sprung pin (not shown) of the mount 20 is released manually. When the pin is released, the frame 19 is freed for pivotal movement as required, for example, when an infant is to sit in the chair or is to leave it.

Cushioning of the chair-seat and back-rest portions 3 and 4 for comfort of the occupant is provided by a cover 24 which also extends down from the front of the portion 3 into the portion 5 to lie under the knees of an infant occupant. The cover 24 has appropriate apertures 25 and 26 (FIG. 3) where attachment of harness (not shown) to the seat portion 3 is to be made for child restraint and safety.

The portion 5 has a series of transverse slots 27 spaced from one another at progressively-increasing distances below the seat portion 3. A plate 28 is entered in one or other of the slots 27 to provide a footrest at the appropriate height for the occupant of the chair. The plate 28 engages resiliently with a plastics moulding 29 attached to the underside of the portion 5 behind the slots 21, for its retention in the respective slot 27. Adjustment of height of the footrest is made simply by pulling the plate 28 to release it from the moulding 29 and slot 27, and pushing it into another slot 27 at the appropriate height, to re-engage it with the moulding 29.

The moulding 1 may be a laminate having a core of plywood or material of honeycomb structure, and external skins of wood veneer or a melamine-formaldehyde methanal resin such as that sold under the Registered Trade Mark FORMICA.

The invention claimed is:

1. A highchair having a front and a rear, the highchair comprising:

an elongate member and a rear-leg support for supporting the elongate member at the rear of the highchair, the rear-leg support being pivoted to the elongate member, and the elongate member being of a one-piece construction comprising a seat of the highchair, a back-rest extending from the seat, and a front leg-support for supporting the elongate member at the front of the highchair, the seat being joined integrally in the one-piece construction with both the back-rest and the front leg-support of the elongate member;

wherein the highchair has selectively an erect condition and a collapsed condition, and the rear-leg support is pivoted to the elongate member to enable the rear leg-support to be selectively folded onto the front leg-support of the elongate member for change of the highchair from the erect condition to the collapsed condition; and a stay-element is pivoted to the rear leg support, and a socket located on the elongate member, the stay-element being selectively engageable with the socket for holding the rear leg-support extended from the rear of the highchair in the erect condition of the highchair.

2. The highchair according to claim 1, wherein the rear leg-support comprises a pair of interconnected, tubular legs, wherein the stay-element comprises a tubular frame located between the tubular legs, and wherein the tubular frame is pivoted to the tubular legs.

3. The highchair according to claim 1, wherein the front leg-support of the elongate member splays outwardly to form foot projections for floor-contact.

4. The highchair according to claim 1, wherein the rear leg-support comprises a pair of legs.

5. The highchair according to claim 4, wherein the legs are pivoted to the seat of the elongate member.

6. The highchair according to claim 1, wherein the elongate member is a one-piece moulding.

7. The highchair according to claim 6, wherein the one-piece moulding is a laminate.

8. The highchair according to claim 7, wherein the laminate has a core of one of wood, a plastics material, and a material having a honeycomb structure.

9. The highchair according to claim 8, wherein the laminate is faced with one of a wood veneer and a plastics material.

10. A highchair having a front and a rear, the highchair comprising:

an elongate member and a rear-leg support for supporting the elongate member at the rear of the highchair, the rear-leg support being pivoted to the elongate member, and the elongate member being of a one-piece construction comprising a seat of the highchair, a back-rest extending from the seat, and a front leg-support for supporting the elongate member at the front of the highchair, the seat being joined integrally in the one-piece construction with both the back-rest and the front leg-support of the elongate member;

a tubular element is attached to the seat of the elongate member, the tubular element extends upwardly on either side of the elongate member to provide arm rests to the seat;

a tray for attachment to the tubular element, the tray having mounts for releasably attaching the tray to the tubular element to extend from the front of the highchair either side of the seat; and the tray includes a tubular frame that is pivoted to the mounts.

* * * * *